US006845581B2

(12) United States Patent
Doerr et al.

(10) Patent No.: US 6,845,581 B2
(45) Date of Patent: Jan. 25, 2005

(54) HANG TAG AND METHOD OF APPLYING HANG TAG TO AN ELONGATED OBJECT

(75) Inventors: Christopher Doerr, Indianapolis, IN (US); Amiel Hepp, Algoma, WI (US); Robert Voss, Saint John, IN (US)

(73) Assignee: Wisconsin Label Corporation, Algoma, WI (US)

( * ) Notice: Subject to any disclaimer, the term of this patent is extended or adjusted under 35 U.S.C. 154(b) by 0 days.

(21) Appl. No.: 09/771,430

(22) Filed: Jan. 26, 2001

(65) Prior Publication Data

US 2001/0049896 A1 Dec. 13, 2001

Related U.S. Application Data

(62) Division of application No. 09/506,757, filed on Feb. 18, 2000, now Pat. No. 6,267,152.

(51) Int. Cl.[7] ..... G09F 3/10

(52) U.S. Cl. ..... 40/673; 40/27; 40/665; 140/93 A; 140/93.2

(58) Field of Search ..... 40/673, 27, 305, 40/299.01, 662, 663, 665; 140/93 A, 93.2, 71 R, 93 R, 102; 24/18

(56) References Cited

U.S. PATENT DOCUMENTS

| | | | | | |
|---|---|---|---|---|---|
| 267,486 | A | * | 11/1882 | Brooks | 40/665 |
| 1,324,568 | A | * | 12/1919 | Shelton | 40/665 |
| 2,328,691 | A | * | 9/1943 | Swett, Jr. | 40/663 |
| 3,354,915 | A | * | 11/1967 | Johnson et al. | 140/93 R |
| 3,513,575 | A | * | 5/1970 | Schiller | 40/640 |
| 3,559,323 | A | * | 2/1971 | Mitchell | 40/305 |
| 4,392,315 | A | * | 7/1983 | Irving et al. | 40/27 |
| 4,914,843 | A | * | 4/1990 | DeWoskin | 40/633 |
| 5,573,825 | A | * | 11/1996 | Brewster | 428/43 |
| 5,685,648 | A | * | 11/1997 | Harris et al. | 384/291 |
| 5,910,353 | A | * | 6/1999 | Machlica | 428/195 |
| 5,947,672 | A | * | 9/1999 | Cohen | 411/525 |
| 6,267,152 | B1 | * | 7/2001 | Doerr et al. | 140/93 A |

OTHER PUBLICATIONS

Printout from the Plastag.com website, 6 pages; Page with die dimensions is dated Jun. 2002.*

* cited by examiner

*Primary Examiner*—William L. Miller
(74) *Attorney, Agent, or Firm*—Leydig, Voit & Mayer, Ltd.

(57) ABSTRACT

A hang tag is disclosed. The hang tag has first and second surfaces, which are preferably planar. A slot is defined between the first and second surfaces. Desirably, the slot extends at least about 0.25 inches in one direction and at least about 1 inch in another direction. Also disclosed is a method and an apparatus for automatically applying a hang tag to an elongated object (e.g., an electrical cord such as a cord set), with a machine that is suitable for applying a securement strap to an object. The method includes providing a hang tag having a slot therein. The hang tag is aligned with the machine so that when the securement strap is ejected from the machine, it passes through the slot, forms a loop around the elongated object, and is tensioned around the object. As such, the securement strap serves to attach the hang tag to the elongated object in a stationary manner.

31 Claims, 7 Drawing Sheets

HANG TAG AND METHOD OF APPLYING HANG TAG TO AN ELONGATED OBJECT

This Application is a Divisional Application of Ser. No. 09/506,757, filed on Feb. 18, 2000 and now U.S. Pat. No. 6,267,152.

TECHNICAL FIELD OF THE INVENTION

The present invention pertains generally to tags. More particularly, the present invention relates to hang tags and methods of applying hang tags to elongated objects, as might be particularly useful for application to electrical cord sets.

BACKGROUND OF THE INVENTION

In order to prevent consumers from suffering serious or even fatal injuries caused by electrical shock, manufacturers of electrical cords, such as cord sets and power supply cords, have sought to caution consumers of the various dangers that exist when electrical cords are not used properly. Electrical cord sets are particularly susceptible to causing injury or death due to electrical shock. For example, if a male end of a cord set is inserted into a power source, a dangerous situation exists unless a female end of the cord set is also appropriately connected, for example, to a power supply cord which is hard-wired into a device, such as, for example, a computer.

Historically, manufacturers typically warned consumers of many of the various hazards caused by improper use of electrical cords on the outer or prime packaging of the electrical cord or associated product. Unfortunately, the warnings included with the packaging were largely unsuccessful in increasing safety because consumers ordinarily discard the packaging prior to initial use of the electrical cord. As such, any communications provided with the packaging were ill-suited for reminding consumers of potential dangers upon subsequent use. The problem was exacerbated when the communications were provided on an inside surface of the packaging because the warnings often would go entirely unnoticed by the consumer.

As a result of the inadequacy of warnings provided with packaging, manufacturers have been increasingly turning to approaches in which a long-term source of cautionary information (regarding electrical cord safety) is permanently affixed to the electrical cord. However, because electrical cords generally have outer insulation jackets that are composed of materials which have a relatively low surface energy (such as various rubbers and thermoplastics), securely attaching the source of the cautionary information has proven to be difficult. In addition, because of the significant "wear and tear" that is typically associated with the use of electrical cords, Underwriters Laboratories Incorporated ("UL") has adopted Standard 817 for Safety of Cord Sets and Power Supply Cords.

In order to obtain UL approval pursuant to Standard 817, the source of the cautionary information, which is attached to the electrical cord (usually within 12 inches of at least one of the ends), must be able to withstand exposure to harsh conditions, such as, heat, humidity, water immersion, freezing temperatures, pulling or snagging, ultraviolet light, and other conditions. Following exposure to such severe conditions, UL 817 requires that the source of cautionary information must be able to hold a 5 lb. (≈2.286 kg) weight without slipping from an original position on the cord by more than 0.5 inches (≈1.28 cm), nor should the source for cautionary information crack by more than 0.06 inches (≈0.16 cm).

By way of example, U.S. Pat. No. 5,658,648 describes adhesive labels that have passed tests which suggest that they are able to withstand long-term "wear and tear" when used as a source for cautionary information when applied to elongated objects, such as electrical cords. In fact, the adhesive labels described in U.S. Pat. No. 5,658,648 have satisfied the requirements necessary for UL 817 approval.

However, the use of adhesive labels as the source of cautionary information has not been fully satisfactory for all electrical cord applications. In particular, some electrical cords are designed specifically for certain applications in which durability is especially important, such as electrical cords designed for outdoor use or specially designed oil-resistant electrical cords (e.g., cords resistant to hydraulic oil, motor oil, fuel oil, and the like). With respect to the latter, some electrical cords are provided with special oil-resistant insulation jackets, which are identified in the art by including the letter "o" in acronyms that are known customarily in the art (e.g., "SJOW-A" refers to an oil-resistant cord, while cords identified as "SJW-A" are not specially designed as oil-resistant).

In fact, UL 817 includes an additional test that must be passed in order to obtain special recognition for electrical cords that are specially designed to be oil-resistant. In this respect, the source of cautionary information that is affixed to the oil resistant insulation jacket must be able to withstand 48 hours of submersion in a fuel oil (e.g., diesel oil or the like) prior to being subjected to the 5 pound test, in order to obtain special recognition under UL 817 for application with oil-resistant cords. To date, it is believed that no affordable or marketable adhesive label has been able to satisfy UL 817 with respect to the fuel oil submersion test.

As an alternative to adhesive labels, another approach for providing a long-term source of cautionary information to electrical cords has involved the use of hang tags. A hang tag is commonly known in the art as a non-adhesive information or graphics source that is suspended on an item to be marked (e.g., an electrical cord) by way of a securement strap, such as, for example, a cable tie, or other form of physical attachment, as opposed to a tag that is sewn onto or inserted into the item to be marked. However, a significant drawback with using hang tags is that they previously have been limited to manual application with respect to electrical cords. Manually applying hang tags to electrical cords is cumbersome and results in increased labor costs and increased production time. Moreover, the Occupational Safety and Health Administration (OSHA) has strict guidelines relating to a minimal wrist movement for operators. Manual application of the hang tags with securement straps requires more wrist movement than OSHA permits.

Previous attempts to automatically apply the hang tags to the electrical cords have not met with success. For example, it has proven difficult to provide a hang tag that can be automatically applied and which also retains sufficient structural integrity to withstand long term "wear and tear" (e.g., to pass UL 817 Standard for cord sets and power supply cords, including those requiring oil resistance).

From the foregoing, it will be appreciated that there exists a need in the art for a method and apparatus for automatically applying a hang tag to an elongated object. It will also be appreciated that there exists a need for a hang tag for elongated objects which can be readily applied automatically, while at the same time, is able to withstand exposure to rigorous environmental conditions, as particularly encountered during use with electrical cords. It is an object of the present invention to provide such a method, apparatus, and hang tag that satisfies these needs. These and other objects and advantages of the present invention, as well as additional inventive features, will be apparent from the description of the invention provided herein.

BRIEF SUMMARY OF THE INVENTION

The present invention provides a hang tag and a method of automatically applying the hang tag to an elongated object, such as, for example, an electrical cord. In particular, the hang tag of the present invention is provided with a slot therein, wherein the slot desirably has dimensions of at least about 0.25 inches by at least about 1 inch. Preferably, the slot initiates at least about 0.1 inches from any particular outside edge of the tag. The slot is preferably substantially elongated in nature. In this respect, it is more preferable that the slot be generally rectangular, and even more preferable that the slot have at least one radiused edge (i.e., an edge that is arcuate or curved).

The present invention also provides a method of automatically applying a hang tag to an elongated object with a machine that is suitable for applying a securement strap to an object. The method comprises providing a hang tag having a slot therein. The slot has minimum dimensions of about 0.25 inches by about 1 inch. The hang tag is aligned with the machine so that, upon deployment of the machine, the securement strap is ejected from the machine so that it passes through the slot and attaches the hang tag to the elongated object. The machine is then deployed so as to automatically apply the hang tag to the elongated object with the securement strap.

In accordance with another aspect of the invention, an apparatus is provided for automatically applying a hang tag having a slot therein to an elongated object by way of a securement strap. The apparatus comprises a mounting apparatus. The apparatus also includes a tag template which is capable of receiving a hang tag. The tag template is fixed to the mounting apparatus and has a first end and a second end. The tag template also has an opening therein corresponding to a position where the slot of the hang tag can be placed when the hang tag is received in the tag template. The apparatus preferably also comprises a trough which is capable of receiving at least a portion of the elongated object. The trough has a first end that is separated from a second end. The trough is coupled to the mounting apparatus so that the first end of the trough is positioned adjacent to the first end of the tag template and the second end of the trough is positioned adjacent to the second end of the tag template. The first end of the trough is capable of receiving a first portion of the elongated object and the second end of the trough is capable of receiving a second portion of the elongated object, such that, when an elongated object is received in the trough, a third portion of the elongated object can extend between the first end of the trough and the second end of the trough. The apparatus also includes a machine suitable for applying a securement strap to an object. The machine is coupled to the mounting apparatus and the machine is aligned so as to be capable of ejecting the securement strap in such a way that the securement strap can be threaded through the slot and around the elongated object.

Advantageously, pursuant to the present invention, by applying a hang tag to an elongated object, particularly electrical cords, long-term cautionary information can be provided to consumers thereby educating consumers as to how to avoid serious injuries and deaths attributed to electrical shock. Significantly, the present invention not only permits automatic application of a hang tag, but the applied hang tag has also passed tests which suggest that it is able to withstand significant long-term "wear and tear" in use, while remaining legible and staying fastened to the electrical cord to which the hang tag is originally attached. In addition, the inventive method, apparatus, and hang tag accommodate adherence to a diverse range of electrical cord insulation sizes and types, which are typically low surface energy materials. Furthermore, the method, apparatus, and hang tag of the present invention are relatively inexpensive and easy to apply rapidly, thereby increasing the volume of production per unit of time.

The present invention will be more fully understood upon reading the following detailed description in conjunction with the accompanying drawings.

BRIEF DESCRIPTION OF THE DRAWINGS

Although the characteristic features of the present invention will be particularly pointed out in the claims, the invention itself, and the manner in which it may be used and made, may be better understood by referring to the following description taken in conjunction with the accompanying drawings, wherein reference numerals refer to like parts throughout the several views. In the drawings:

DETAILED DESCRIPTION

The present invention is predicated, at least in part, on automatically securing a hang tag to an elongated object with a securement strap. In this respect, the following description relates to one particular utility for the present invention, namely, the automatic application of a hang tag (e.g., which conveys cautionary information) to an electrical cord, such as, for example, a cord set. However, it will be understood that the present invention can also be used to apply a hang tag via a securement strap to other types of elongated objects (including bundles of elongated objects), as desired.

Figure 1:
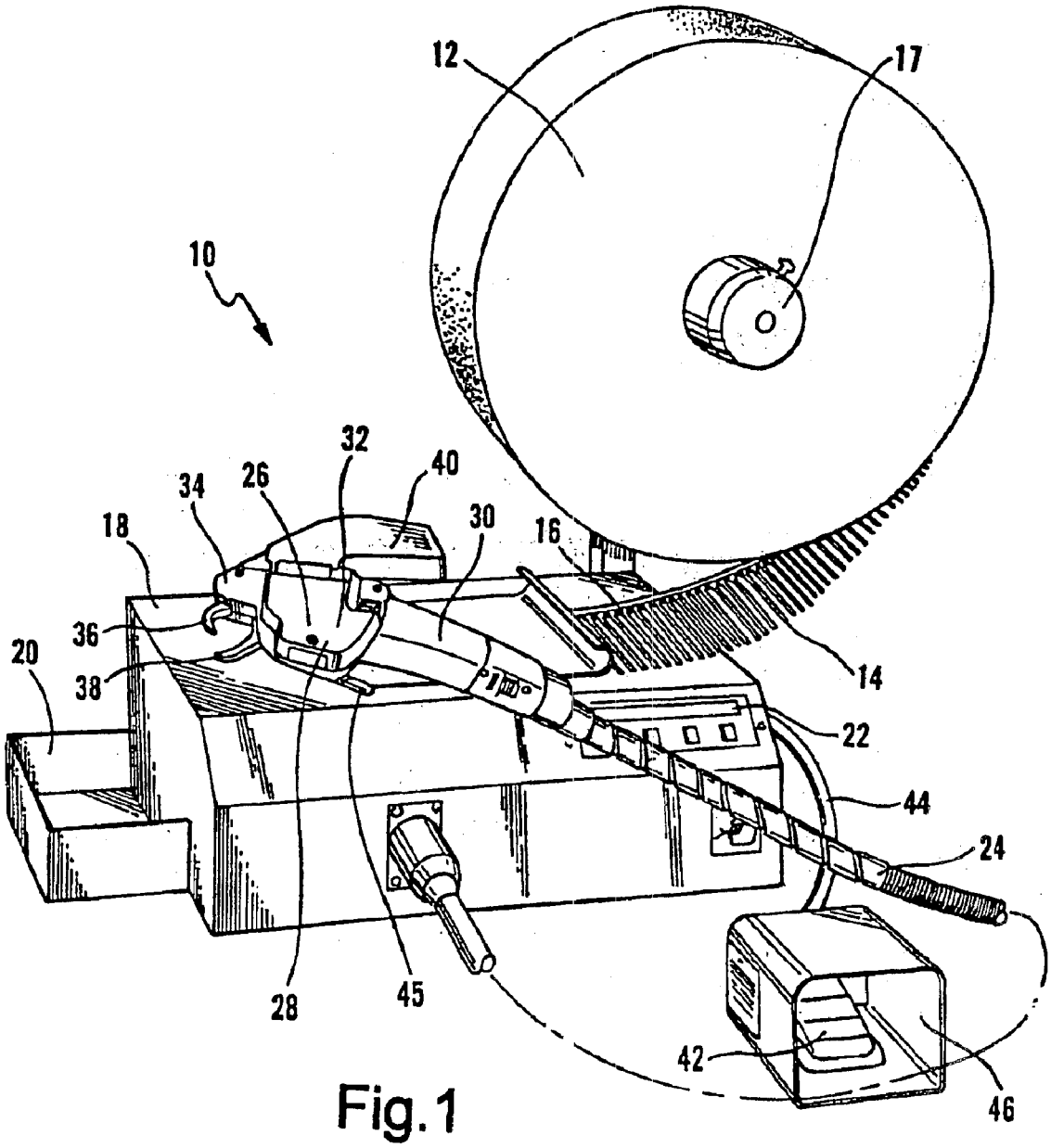
FIG. 1 is a perspective view of an automatic securement strap applicator.
Figure 3A:
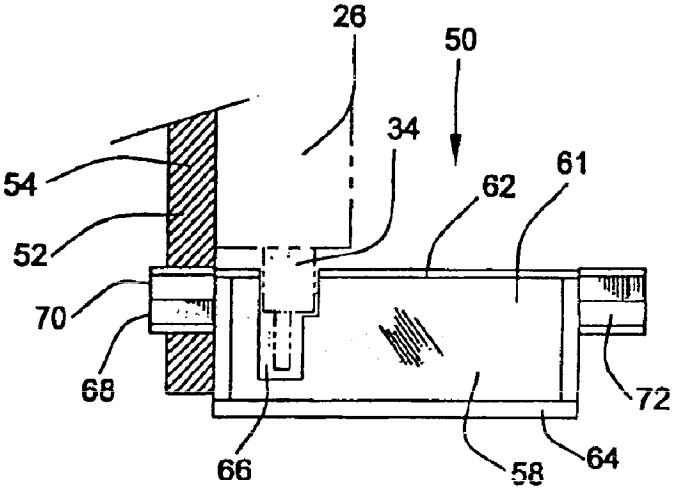
FIG. 3A is a projected face view of the tag securement strapping system shown in FIG. 2A, but shown with a tool head from the automatic securement strap applicator included.
Figure 3B:
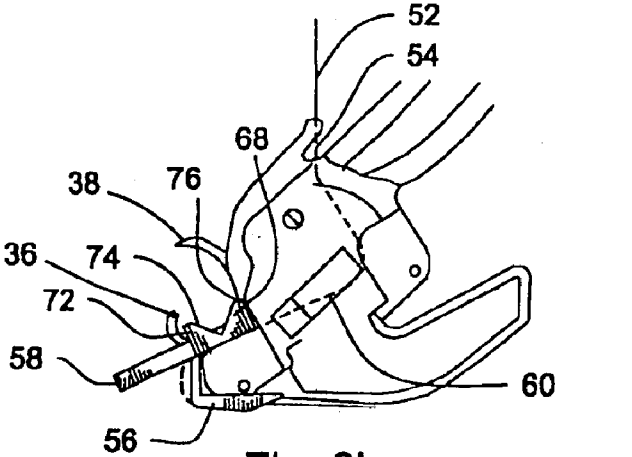
FIG. 3B is a right side elevational view of the tag securement strapping system shown in FIG. 3A.
Figure 2A:
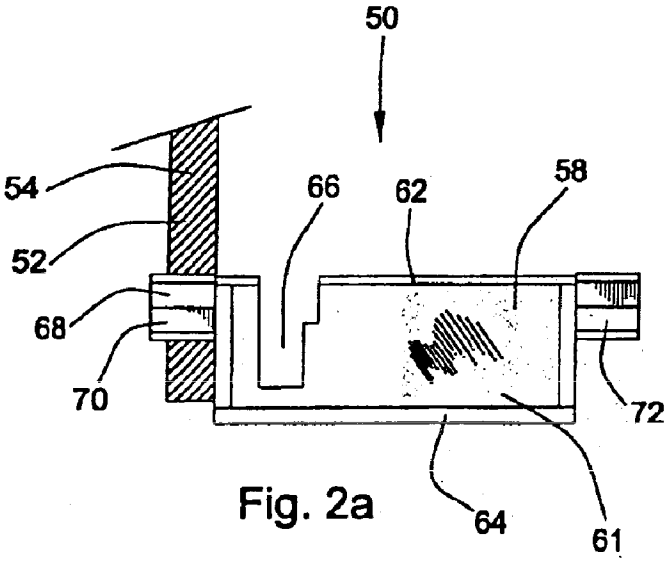
FIG. 2A is a projected face view of a tag securement strapping system which can be used, for example, with an automatic securement strap applicator such as the one shown in FIG. 1.
Figure 2B:
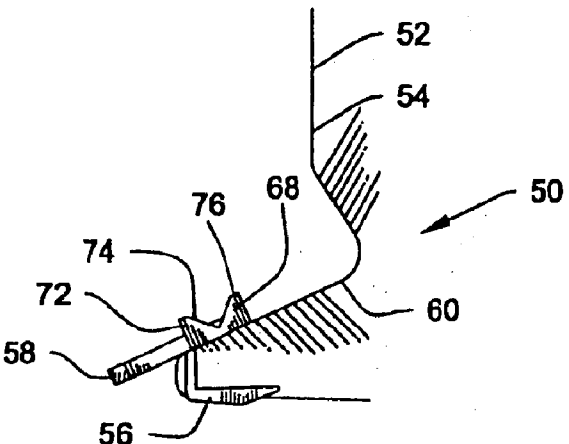
FIG. 2B is a right side elevational view of the tag securement strapping system shown in FIG. 2A.
Figure 5A:
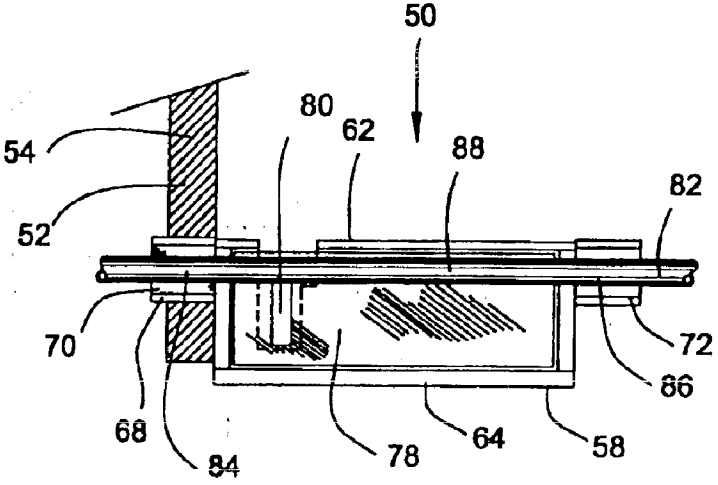
FIG. 5A is a projected face view of the tag securement strapping system shown in FIG. 4A, but with a cord included.
Figure 5B:
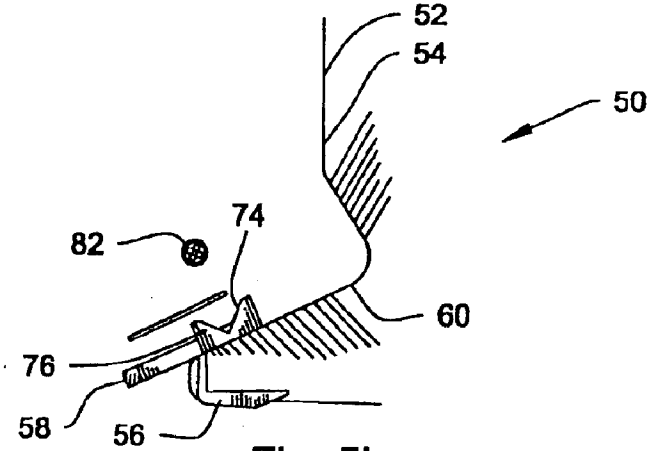
FIG. 5B is a right side elevational view of the tag securement strapping system shown in FIG. 5A, with the tag and cord shown in an exploded manner.
Figure 4A:
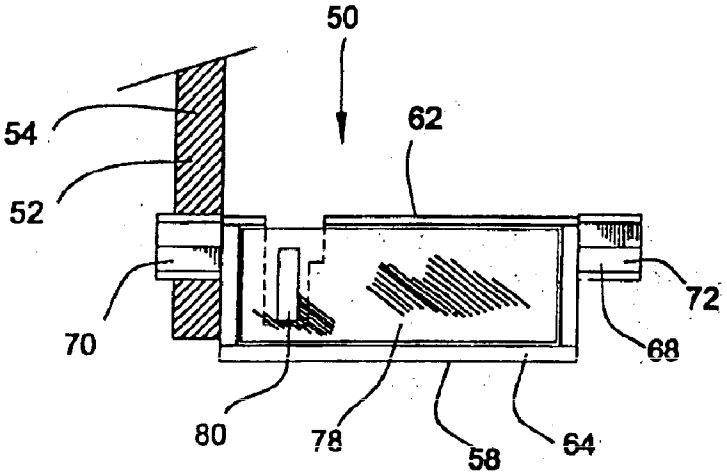
FIG. 4A is a projected face view of the tag securement strapping system shown in FIG. 2A, but shown with a tag included.
Figure 4B:
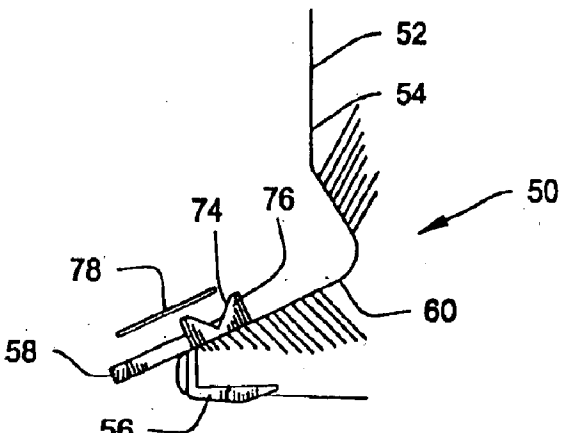
FIG. 4B is a right side elevational view of the tag securement strapping system shown in FIG. 4A, with the tag shown in an exploded manner.
Figure 6A:
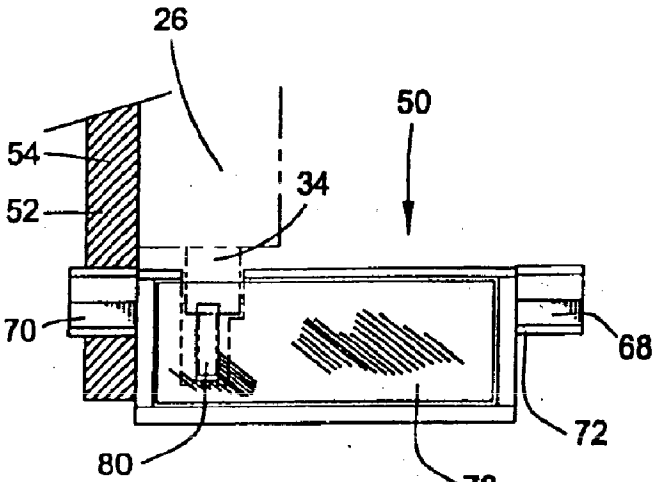
FIG. 6A is a projected face view of the tag securement strapping system shown in FIG. 3A, but shown with a tag included.
Figure 6B:
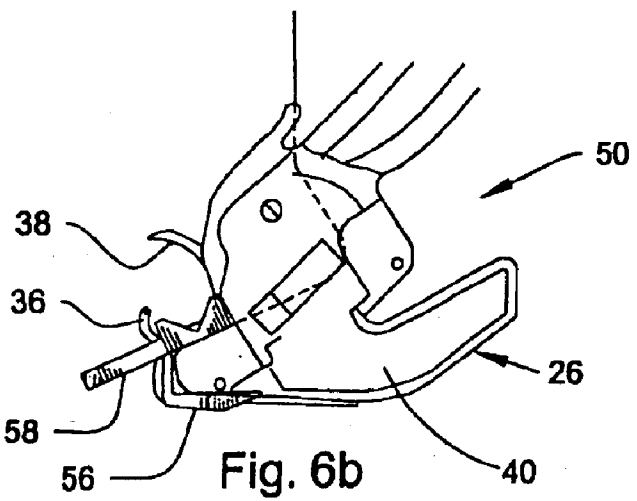
FIG. 6B is a right side elevational view of the tag securement strapping system shown in FIG. 6A.
Figure 7A:
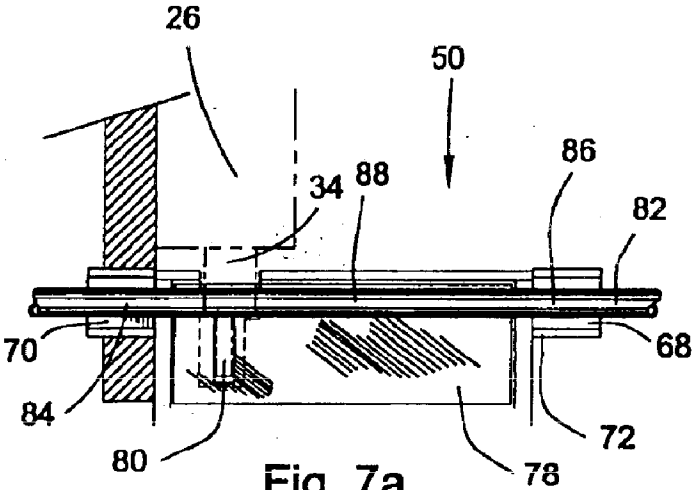
FIG. 7A is a projected face view of the tag securement strapping system shown in FIG. 6A, but shown with a cord included.
Figure 7B:
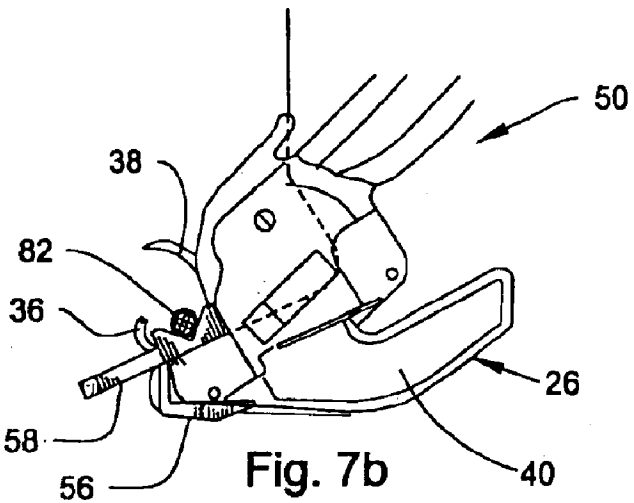
FIG. 7B is a right side elevational view of the tag securement strapping system shown in FIG. 7A prior to application of the securement strap to the cord.

Referring now to the figures in detail, FIG. 1 depicts an exemplary machine which is suitable for applying a securement strap to an object, which machine is also referred to herein as an automatic securement strap applicator 10, and which machine the present invention has particular utility with. Strictly by way of example, suitable commercially available automatic securement strap applicators 10 include, but are not limited to, models PAT1M and PAT1.5M, available from Panduit Corporation, Tinley Park, Ill.

The strap applicator 10 includes a reel 12 of securement straps 14 (e.g., cable ties), which are generally continuously molded in relatively large numbers (usually thousands, e.g., five thousand). The individual securement straps 14, as affixed to a carrier strip 16, are positioned on the reel 12 (e.g., made of fiberboard) having a central core 17 (e.g., made of plastic). The securement strap 14 and carrier 16 can be made of any suitable material, such as, for example, suitable thermoplastics (e.g., nylon 66). Strictly by way of example, suitable commercially available securement straps 14 include, but are not limited to, model PLT1M-XMR or model PLT1M-XM00 (the latter being especially desirable for outdoor use), which are available from Panduit Corporation.

As the reel 12 unwinds, the securement straps 14 are fed successively into a dispenser 18, which contains the control logic of the strap applicator 10. Among other things, the dispenser 18 functions to separate each securement strap 14 (e.g., by way of a "chopper" mechanism) from the carrier strip 16. Scraps of carrier are ejected from the dispenser 18 and deposited in a tray 20. The dispenser 18 also includes a microprocessor-controlled electronic(e.g., LCD or LED) display 22. Desirably, the display 22 provides a user with warnings and/or information regarding the operation of the strap applicator 10, such as, for example, the location of any blockage or other malfunction information.

Figure 8A:
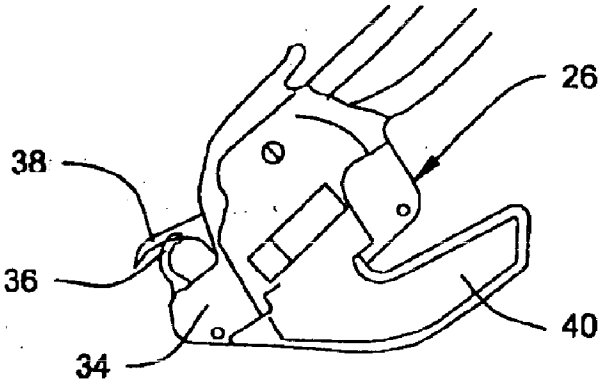
FIG. 8A is a side elevational view of the hand tool of the securement strap applicator system shown in FIG. 1, with the jaws of the tool interacting as when triggering application of the securement strap.
Figure 8C:
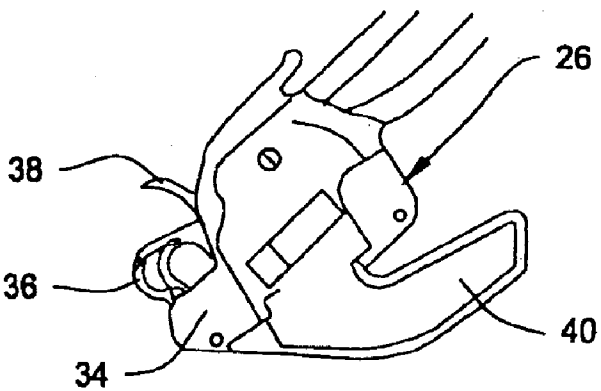
FIG. 8C is a side elevational view of the hand tool of the securement strap applicator system shown in FIG. 1, illustrating the movement of the jaws.
Figure 7C:
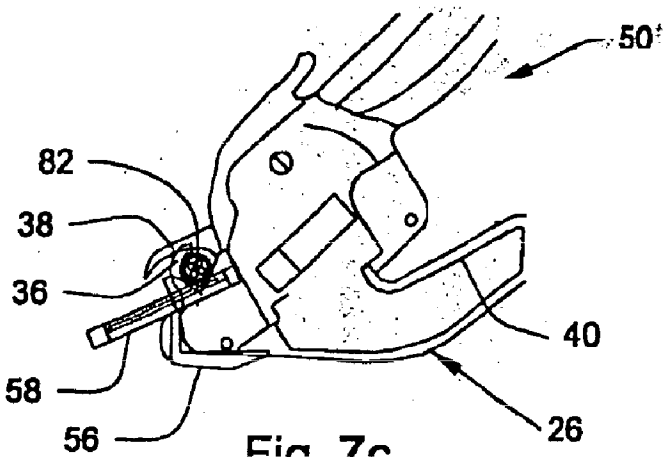
FIG. 7C is a right side elevational view of the tag securement strapping system shown in FIG. 7B as the securement strap is applied to the cord.
Figure 8B:
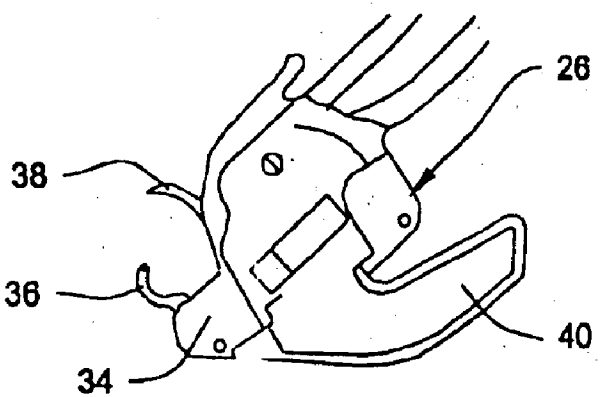
FIG. 8B is a side elevational view of the hand tool of the securement strap applicator system shown in FIG. 1, with the jaws of the tool apart in a resting position prior to triggering application of the securement strap.

When triggered (e.g., by receiving a signal), the dispenser 18 fires (e.g., pneumatically) a securement strap 14 through a transfer hose 24 very rapidly (e.g., in less than one second). In particular, the securement strap 14 passes through the transfer hose 24 and into a hand tool 26. The hand tool 26 includes a housing 28 and a handle 30. The hand tool 26 also includes a body 32 including a tool head 34 which comprises a pair of opposing, generally U-shaped jaws 36 and 38. The release of each securement strap 14 from the strap applicator 10 is guided by the jaws 36 and 38, which are movable relative to each other, as seen, for example, in FIGS. 8A–8C.

As will be appreciated by one of ordinary skill in the art, during ejection from the tool 26, the securement strap 14 is guided along an inner surface of each of the jaws 36 and 38. Generally, the strap is threaded so as to form a loop around an object (as discussed below) on which the securement strap 14 is to be applied, and the strap 14 is then tensioned to a predetermined desired level, as will be appreciated by one of ordinary skill in the art. An excess portion of the strap 14 is cut off after tensioning is complete and then ejected into a reservoir 40 that extends from the tool head 34. The operation of the jaws 36 and 38 is discussed in more detail herein below.

The strap applicator 10 can be activated in any suitable manner. In some embodiments, the strap applicator is provided with a foot pedal 42 (thereby permitting "hands-free" activation) which is connected to the dispenser 18 by way of an air hose 44. The foot pedal 42 is provided in a pedal housing 46 for convenience. By depressing the foot pedal 42, a pneumatic "signal" is sent through the air hose 44 to a trigger 45 positioned on or adjacent to the handle 30. For example, in some embodiments, depressing the foot pedal 42 permits air to flow to a valve (e.g., on a mounting apparatus, as discussed below) which, in turn, is positioned to depress the trigger 45 when activated, as will be appreciated by one of ordinary skill in the art. Meanwhile, activation of the trigger 45 puts pressure on a switch disposed just inside the tool housing 28. Activation of the switch, in turn, sends a signal to the dispenser 18 to activate firing of a securement strap 14. However, it will be appreciated by one of ordinary skill in the art that the applicator 10 can be actuated by other means, such as, for example, robotically (e.g., "electronic eyes"), such that when an object on which the securement strap 14 is to be applied (as discussed below) is moved into a certain position, the applicator 10 is automatically triggered. In other embodiments, the applicator 10 can be triggered by other sensor mechanisms, by manually depressing the trigger 45, or the like.

In accordance with an aspect of the present invention, a tag securement strapping system 50 is provided, as seen, for example, in FIGS. 2–8. The tag securement strapping system 50 utilizes the automatic securement strap applicator 10. It will be understood that the securement strapping system 50 can be utilized in conjunction with other embodiments of securement strap applicators, if desired. In the tag securement strapping system 50, the hand tool 26 is mounted (e.g., via bolts), as will be appreciated by one of ordinary skill in the art, on a mounting apparatus 52, which includes a bracket 54, as seen, for example, in FIGS. 3A–3B, 6A–6B, and 7A–7C. The mounting apparatus also includes an L-shaped support or base 56, which can be placed on, for example, a table top, bench top, or the like. The bracket 54 and base 56 can be formed of any suitable material, and preferably are formed of a metal such as, for example, steel or aluminum.

Notably, the tag securement strapping system 50 includes a fixed tag template 58 for receiving a tag. The tag template 58 is mounted on the mounting apparatus 52. In this respect, the tag template 58 is desirably positioned in a plane that is tilted toward the user (e.g., to facilitate access), as best seen in FIGS. 2B, 3B, 4B, 5B, and 6B. As such, the bracket 54 desirably includes a sloped portion 60 such that the tag template 58 can rest and be coupled (in a manner as will be apparent to one of ordinary skill in the art) to the mounting apparatus 52 thereon. However, it will be appreciated that the tag template 58 can be provided in any suitable manner and at any suitable angle or any suitable position (tilted or untilted) relative to the bracket 54, pursuant to the present invention.

The tag template 58 includes a surface 61 which is dimensionally compatible with a tag to be received thereon, as described herein below. Preferably, the surface 61 is generally elongated (e.g., rectangular), but it can be in any suitable shape corresponding to a desired shape for the tag. The tag template 58 includes a pair of raised, short walls 62 and 64 such that the surface 61 extending therebetween is indented. As a result, a tag can be placed in a fixed manner in the tag template 58, as discussed herein below. The tag template 58 can be formed of any suitable material, such as suitable metals and durable plastics. Strictly by way of example, the tag template 58 can be formed of steel, aluminum, porcelain, glass, ceramic, clay, wood, plastic, or any other form-hardened material, combinations thereof, or the like.

In addition, a notch 66 is defined within the tag template 58. The notch 66 desirably provides clearance so that the tool head 34 and jaws 36 and 38 can extend thereinto. The notch 66 is in a staggered configuration with respect to its width, as seen, for example, in FIGS. 2A and 3A. Such a staggered configuration specifically provides separate clearance dimensions for the tool head 34 and the jaws 36 and 38. However, it will be appreciated that the notch 66 need not take on such a staggered configuration, and, in other embodiments according to the invention, the notch 66 can have a uniform width that provides sufficient clearance for both the tool head 34 and the jaws 36 and 38. In other embodiments, the tag template 58 can be in two separate pieces, with a void area (in lieu of a notch) provided therebetween. The void area between the two pieces should be large enough to permit the jaws 36 and 38, and preferably, the tool head 34, to lie between the two pieces of the tag template 58. Accordingly, the tag template 58 must have an opening (e.g., a notch or void area) therein corresponding to the placement of a slot formed within a hang tag (as discussed herein below) so that clearance is provided for at least one of the jaws 36 and/or 38 to guide a securement strap 14 (ejected from the strap applicator 10) through the slot.

The tag securement strapping system 50 also includes a trough 68 which can receive at least a portion of an electrical cord (e.g., cord set) therein. The trough 68 has a first end 70 and a second end 72. The second end 72 is separated from the first end 70. In particular, the trough 68 extends (e.g., perpendicularly adjacent) on either side of the tag template 58.

The trough 68 can have any suitable dimensions so that at least a portion of an electrical cord (i.e., a region of the cord where a tag is desired to be placed) can be received therein. By way of example, and not limitation, each end 70 and 72 of the trough 68 desirably can have a length of from about 6 inches to about 12 inches. The trough 68 includes an indented surface 74 surrounded by a raised wall 76. In this respect, the indented surface 74 desirably accommodates the circumferential shape (e.g., annular) of an electrical cord. Strictly by way of example, the indented surface 74 can be in a V-block (as shown) or U-shaped configuration. As a result, at least a portion (e.g., one end, such as the male end) of an electrical cord can be placed in the trough 68 and placed in a desired position defined by the trough 68 location, as will be discussed in more detail herein below. In addition, the size and shape of the trough 68 can vary, as desired, depending upon the size, circumference and/or shape of the electrical cord, including electrical cord sets, such as cords identified as SJTW, SJEW, SPT, SJOW, SJTOW, HPN, and the like.

The trough 68 is coupled to the mounting apparatus 52, as will be appreciated by one of ordinary skill in the art, on the sloped surface 60 supported by the L-shaped base 56. It will be appreciated that the trough 68 can be coupled to the mounting apparatus 52 in any other suitable manner. In addition, the trough 68 can be formed of any suitable material, such as suitable metals and durable plastics. Strictly by way of example, the trough 68 can be formed of steel, aluminum, porcelain, glass, ceramic, clay, wood, plastic, or any other form-hardened material, combinations thereof, or the like.

Figure 9A:
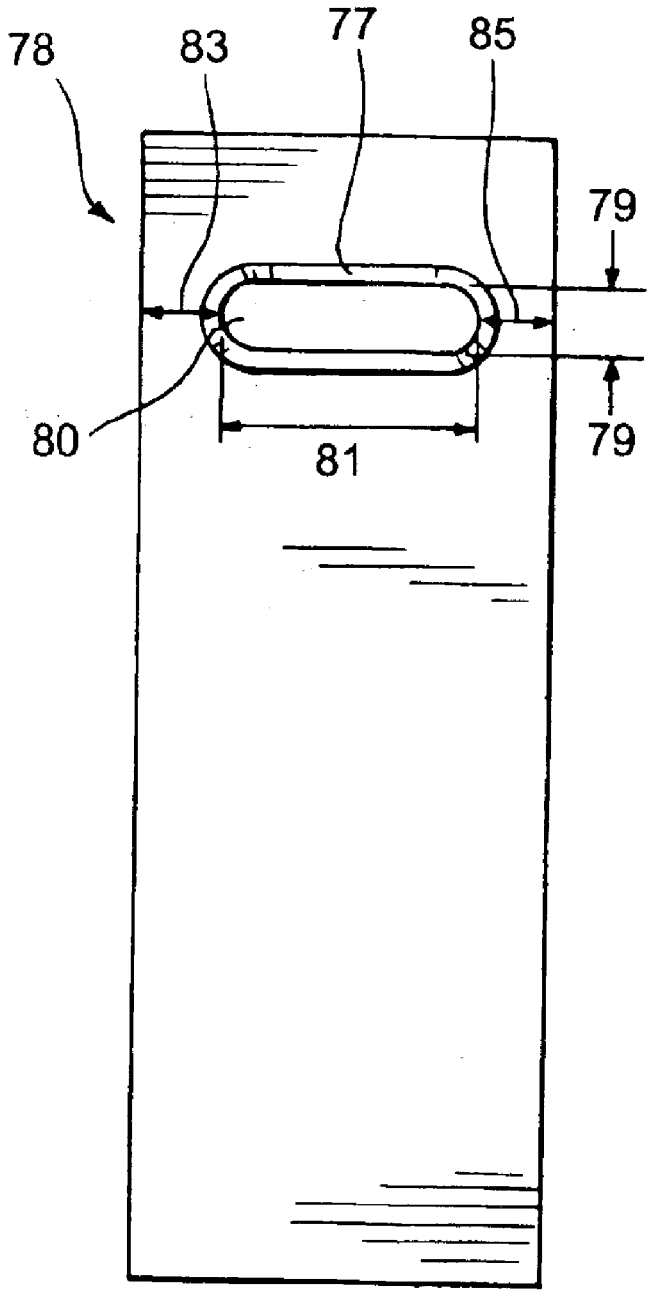
FIG. 9A depicts an exemplary hang tag in accordance with the present invention.
Figure 9B:
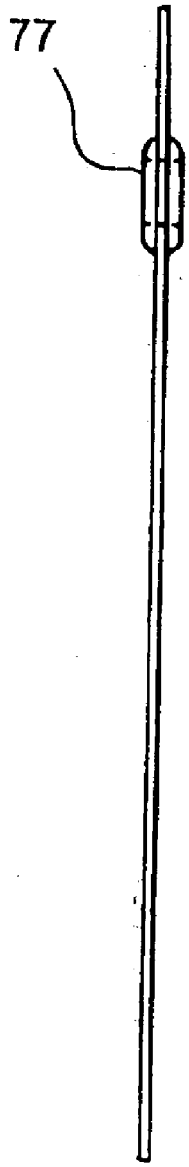
FIG. 9B is a side elevational view of the exemplary hang tag shown in FIG. 9A, in accordance with the present invention.

Referring now to FIG. 9, a hang tag 78 is provided, in accordance with another aspect of the present invention. The hang tag 78 is desirably durable and has suitable tensile strength and elongation characteristics such that the hang tag 78 avoids tearing or breakage, for example, when subjected to "wear and tear" tests pursuant to UL Standard 817 for hang tags. Preferably, the hang tag 78 is able to pass the aspects of UL Standard 817 pertaining to oil submersion and exposure to ultraviolet (UV) light as well.

The hang tag 78 can form any suitable shape and can have any suitable dimensions. Preferably, the hang tag 78 forms a substantially rectangular shape for convenience. For example, the width of the hang tag 78 is preferably greater than about 1 inch, more preferably, greater than 1.625 inches and, even more preferably, the width is from about 1.75 inches to about 12 inches. Meanwhile, the length of the hang tag 78 is preferably greater than about 1 inch, more preferably, greater than about 3.96 inches and, even more preferably, the length is from about 4 inches to about 12 inches. The hang tag 78 can have any suitable thickness but the thickness is preferably selected so as to enhance the durability (e.g., enhance resistance to tearing or breakage) of the hang tag 78. Preferably, the thickness of the hang tag 78 ranges from about 1 mils to about 30 mils, more preferably, from about 5 mils to about 10 mils.

The hang tag 78 is preferably relatively planar and includes a slot 80 therein which serves as an opening for a securement strap 14 (e.g., a cable tie) to be threaded therethrough, and which permits jaw 36 and/or 38 clearance for the tool 26, as necessary for automatic application of the hang tag 78, as discussed herein above. Significantly, the slot 80 has minimum dimensions of at least about 0.25 inches by at least about 1 inch. Preferably, the slot has minimum dimensions of at least about 0.312 inches by about 1.25 inches, and more preferably, minimum dimensions of at least about 0.375 inches by about 1.375 inches.

The slot 80 can be in any suitable shape, such as, for example, substantially rectangular, square, circular, ellipsoidal, obround, or the like. Preferably, the slot 80 is elongated so as to promote jaw 36 and/or 38 clearance for the tool 26. More preferably, the slot 80 is substantially rectangular, and even more preferably, the slot 80 has at least one arcuate edge (i.e., radiused). However, regardless of the shape of the slot 80, the minimum dimensions of the slot should extend a distance (at its maximum extension) of at least about 0.25 inches in a first direction (between the arrows 79 in FIG. 9) and at least about 1 inch in a second direction 81 (as identified in FIG. 9). For example, in the case of a circle, the minimum dimensions in the first and second directions would be the same.

The hang tag 78 can be formed of any suitable durable material, in view of the relatively large size of the slot 80, so that the hang tag 78 resists tearing and other effects of "wear and tear." For example, at least a portion, and preferably, substantially all, of the hang tag 78 can be formed of a durable thermoplastic, such as, for example, polyethylene such as high density polyethylene, polyester, polystyrene, polyolefins (e.g., TYVEK®), polypropylene, polyphenylene, polycarbonate, polyvinylchloride, nylons, acrylics, or metals, such as, for example, aluminum, combinations thereof, and the like.

Preferably, the hang tag 78 is formed of an oriented, cross-laminated film. It is noteworthy that a cross-laminated film differs from a cross-linked product. In this respect, a cross-laminated film pertains to a multi-ply product that includes individual plies that are positioned so that their orientation directions are at 45° angles in structure, thereby achieving desirable tensile and tear properties, in accordance with embodiments of the present invention. For example, the cross-laminated film can be formed as an extruded product using blown film technology. One example of a commercially available cross-laminated material is C2S Valeron Film (e.g., 7.5 mil). which is available from Van Leer Strength Films, Houston, Tex. The C2S Valeron Film includes 4 oriented strength plies, 3 lamination plies, a clay coating, and a binder in the clay coating that promotes adherence to the Valeron film. A thin layer of polyethylene is present between each of the oriented plies. However, it is to be noted that the hang tag 78 does not need to be cross-laminated inasmuch as the hang tag 78 could be reinforced in another manner, such as, for example, the use of a grommet 77 which could be made of metal (e.g., brass) or plastic.

It will be appreciated that the hang tag 78 can include any suitable colorant, as desired. In this respect, the hang tag 78 can include a white coloring agent, such as, for example, a titanium dioxide ($TiO_2$) white pigment, or other colorants (e.g., to promote opacity) including, but not limited to, zinc phosphate, zinc oxide, zinc sulfide, lithopone, combinations thereof, and the like.

Notably, the slot 80 is positioned at a distance greater than about 0.1 inches from any edge of the hang tag 78, i.e., the slot 80 has a minimum distance from any edge of the hang tag 78 (e.g., identified as "83" or "85" in FIG. 9) that is greater than about 0.1 inches. More preferably, the slot 80 is positioned at least about 0.15 inches away from any edge of the hang tag 78, and even more preferably, the slot 80 is positioned at least about 0.3 inches from any edge of the hang tag 78. In this respect, the slot 80 is positioned away from the edges of the hang tag 78 in order to minimize susceptibility of the hang tag 78 to tearing or breakage. Particularly, the slot 80 position compensates for the relatively large nature of the slot 80 (e.g., at least about 0.25 inches by at least about 1 inch) so as to minimize the risk of tearing and/or breakage of the hang tag 78. In some embodiments, the slot 80 is positioned as close as possible to the edges of the hang tag 78, while still exceeding 0.1 inch from the edges of the hang tag 78 (e.g., from about 0.1 to about 0.3 inches from the edges of the hang tag 78).

The inventive hang tag 78 can be formed in any suitable manner. For example, the slot 80 can be formed by way of a male/female punch unit so as to ensure precision in providing desired slot 80 sizes. As will be appreciated by one of ordinary skill in the art, such punch dies desirably include timing pins and slots to ensure proper alignment, and each punch and die fits into its own precision machine hole for punching accuracy. Vacuum cups can be supplied to permit efficient waste removal of the material removed in forming the slot 80, thereby promoting a clean diecut station. Furthermore, the outer hang tag 78 shape is cut with a rotary metal to metal cutting die, which can be formed, for example, of a hardened tool steel by an electronic discharge machining process to enhance durability.

In use, the hang tag 78 can be manually applied, or, preferably, automatically applied, e.g., by way of the tag securement strapping system 50. In this respect, the hang tag 78 can be positioned in the fixed tag template 58, as best seen in FIGS. 4A–4B, 5A–5B, and 6A–6B. In particular, placement of the hang tag 78 in the fixed tag template 58 permits a user to easily and properly align a hang tag 78 in preparation for automatic application. Moreover, the raised walls 62 and 64 of the fixed tag template 58 facilitate precision in placing the tag 78 properly prior to actuating the tool 26. Significantly, the tag 78 is placed in the tag template 58 so that the slot 80 is disposed in a position corresponding to the notch 66 so as to permit sufficient clearance for attachment of a securement strap 14 as discussed herein below.

Particularly, the hang tag 78 can be automatically applied to an electrical cord 82, as seen, for example, in FIGS. 5A–5B and 7A–7C. While the hang tag 78 is placed in the fixed tag template 58, the cord 82 is positioned in the trough 68 so that a first portion 84 of the cord 82 is positioned in the first end 70 of the trough 68 and a second portion 86 of the cord 82 is positioned in the second end 72 of the trough 68, with a third portion 88 of the cord 82 extending snugly over the hang tag 78 between the two ends 70 and 72 of the trough 68. Notably, the trough 68 is desirably positioned in such a way so that the cord 82 covers as little of the slot 82 as possible so that there is sufficient room for the jaws 36 and 38 to maneuver.

Figure 10A:
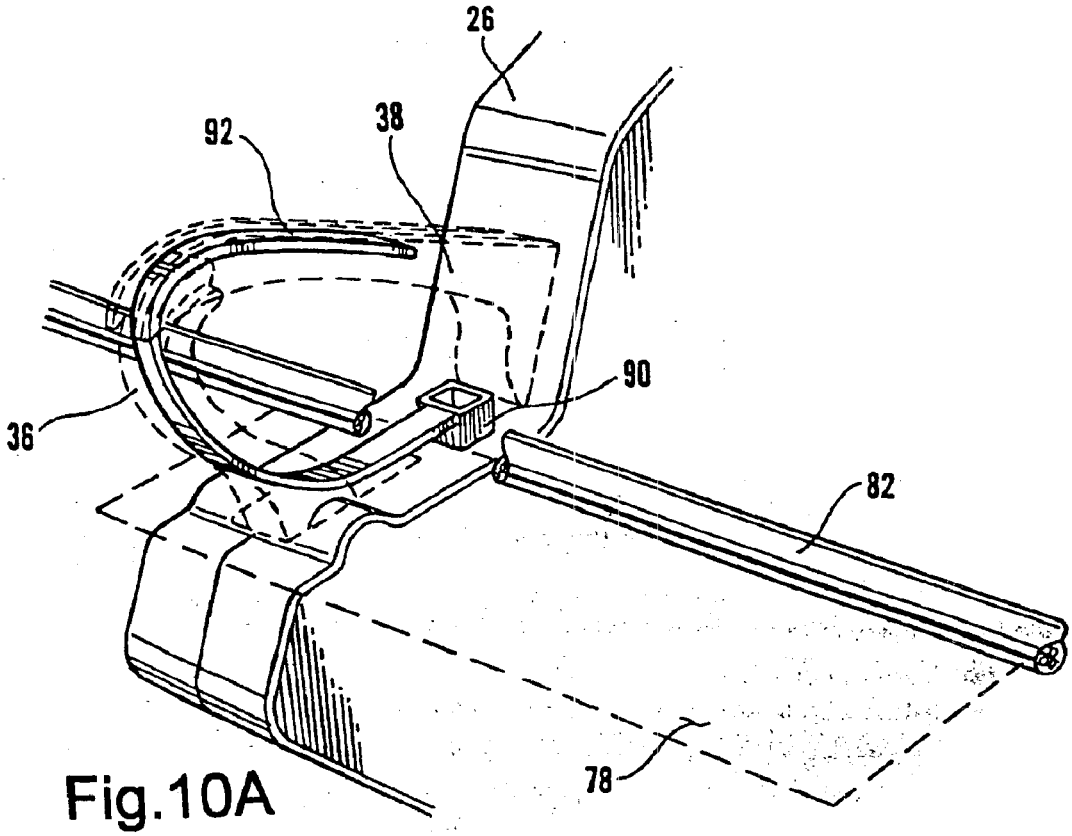
FIGS. 10A and 10B are enlarged perspective views of the jaws of the hand tool shown in FIGS. 8A–8C, illustrating the application of a securement strap to secure a tag to a cord, in accordance with the present invention.
Figure 10B:
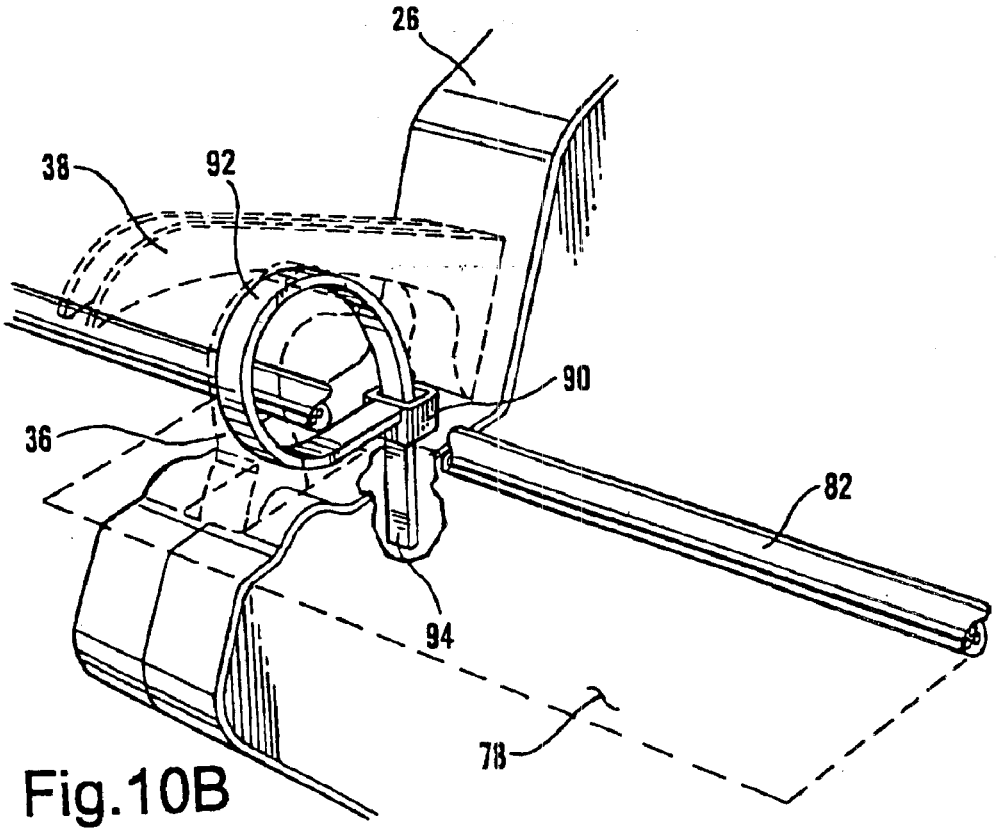

Turning now to FIGS. 10A–10B, the application of a hang tag 78 by way of the securement strap 14 (e.g., a cable tie) to an electrical cord 82 is shown. As will be appreciated by one of ordinary skill in the art, the securement strap 14 includes a head 90 and a tail 92. After the dispenser 18 receives a signal to fire, the securement strap 14 is ejected from the tool 26, with the tail 92 ejected first. More particularly, the tail 92 travels along a groove disposed on the inner surface of the jaws 36 and 38. The tail 92 travels from the first jaw 36 and then circles along the second jaw 38. Meanwhile, the head 90 remains stationary because a segment within the tool head 34 (e.g., a "head stop") mechanically stops the head 90 from continuing forward. The jaws 36 and 38 first connect (as seen in FIG. 10A) and then the jaw 36 continues forward so as to thread the tail 92 of securement strap 14 through the stationary head 90 to a desired predetermined tension level, as will be appreciated by one of ordinary skill in the art. An excess portion 94 of the securement strap 14 can be cut off, e.g., by a chopping mechanism.

As seen in FIGS. 10A–10B, the slot 80 in the hang tag 78 is sufficiently large to permit the jaw 36 to travel through. The cord 82 desirably is lined up adjacent to an edge of the slot 80 so that obstruction of the slot 80 by the cord 82 is minimized and maximum clearance in the slot 80 for the jaws 36 and/or 38 is achieved. Accordingly, the hang tag 78 is automatically fixed in a stationary manner on the cord 82 via the securement strap 14.

The following examples further illustrate the present invention but, of course, should not be construed as in any way limiting its scope.

EXAMPLE 1

This example illustrates the durability and resistance to "wear and tear" of hang tags according to the invention.

In particular, three hang tags (i.e., Tag #1, Tag #2, and Tag #3) were prepared. Each hang tag was formed from a C2S Valeron Film (7.5 mil). Each hang tag was prepared with a generally rectangular slot defined therein, having radiused edges. The slot in each of the hang tags had dimensions of 0.375 inches by 1.375 inches. Tag #1 had a slot with a minimum distance of 0.20 inches from any edge of the hang tag. Tag #2 had a slot with a minimum distance of 0.156 inches from any edge of the hang tag. Tag #3 had a slot with a minimum distance of 0.15 inches from any edge of the hang tag. Each tag was attached and tensioned to an electrical cord using a cable tie (Panduit PLT1M-XMR).

Each tag was subjected to all of the tests required for passing UL Standard 817 (see, e.g., U.S. Pat. No. 5,658,648). All three hang tags (#1–#3) passed all of the UL 817 tests, including 48 hours submersion in fuel oil (i.e., Fuel Oil #1 specified in UL 817) and 720 hours UV exposure.

Comparative Example 1A

A hang tag was prepared and attached to an electrical cord in accordance with Example 1, except that the minimum distance of the slot to any edge of the hang tag was 0.1 inches. The tag failed abruptly within seconds of application of a 5 pound weight pursuant to UL 817 even in the absence of any of the exposure tests of UL 817.

While this invention has been described with an emphasis upon certain embodiments, it will be apparent to those of ordinary skill in the art that variations of the embodiments disclosed herein may be used and that it is intended that the invention may be practiced otherwise than is specifically described herein. Accordingly, this invention includes all modifications encompassed within the spirit and scope of the invention as defined by the following claims.

What is claimed is:

1. A hang tag capable of automatically and permanently being attached to an elongated object by a machine having at least one jaw suitable for applying a securement strap to the object, the hang tag comprising:

a first surface, a second surface, and a slot defined therebetween, wherein said slot has minimum dimensions of at least 0.25 inches by 1 inch thereby permitting the jaw to travel through the slot so that the securement strap is threaded through the slot automatically by the jaw of the machine;

wherein the hang tag can hold a 5 lb weight without slipping from an original position on the elongated object by more than 0.5 inches.

2. The hang tag of claim 1, wherein at least a portion is formed of a material selected from the group consisting of polyethylene, polystyrene, polyolefins, polyphenylene, polycarbonate, polyvinylchloride, nylons, acrylics, aluminum, and combinations thereof.

3. The hang tag of claim 1, wherein at least a portion of the hang tag is formed of a cross-laminated material.

4. The hang tag of claim 3, wherein the cross-laminated material includes a high density polyethylene.

5. The hang tag of claim 1, further comprising a grommet reinforcing said slot.

6. The hang tag of claim 1, wherein said slot has minimum dimensions of at least about 0.312 inches by about 1.25 inches.

7. The hang tag of claim 6, wherein said slot has minimum dimensions of at least about 0.375 inches by about 1.375 inches.

8. The hang tag of claim 1, wherein said slot is substantially elongated.

9. The hang tag of claim 8, wherein said slot is substantially rectangular.

10. The hang tag of claim 9, wherein said slot has at least one arcuate edge.

11. The hang tag of claim 1, wherein the hang tag has at least one additional property selected from the group consisting of:

(a) at least a portion of the hang tag is formed of a material selected from the group consisting of durable thermoplastics;

(b) the hang tag can hold the 5 lb weight without slipping from an original position on the elongated object by more than 0.5 inches after the tag has been submersed in a fuel oil for 48 hours;

(c) the hang tag further comprises at least one edge, wherein said slot is provided more than about 0.10 inches from each edge;

(d) the hang tag has a thickness of about 1 mils to about 30 mils; and (e) combinations of any of (a)–(d).

12. The hang tag of claim 11, wherein the hang tag further comprises at least one edge, wherein said slot is provided more than about 0.10 inches from each edge.

13. The hang tag of claim 12, wherein said slot is provided at least 0.15 inches from each edge.

14. The hang tag of claim 13, wherein said slot is provided at least 0.30 inches from each edge.

15. The hang tag of claim 11, wherein the hang tag can hold the 5 lb weight without slipping from an original position on the elongated object by more than 0.5 inches after the tag has been submersed in a fuel oil for 48 hours.

16. The hang tag of claim 11, wherein said slot is substantially elongated.

17. The hang tag of claim 16, wherein said slot is substantially rectangular.

18. The hang tag of claim 17, wherein said slot has at least one arcuate edge.

19. The hang tag of claim 11, wherein at least a portion of the hang tag is formed of a material selected from the group consisting of durable thermoplastics.

20. The hang tag of claim 19, wherein the durable thermoplastic is selected from the group consisting of polyethylene, polystyrene, polyolefins, polyphenylene, polycarbonate, polyvinylchloride, nylons, acrylics, and combinations thereof.

21. The hang tag of claim 20, wherein the durable thermoplastic is a cross-laminated material.

22. The hang tag of claim 21, wherein the cross-laminated material includes a high density polyethylene.

23. The hang tag of claim 11, further comprising a grommet reinforcing said slot.

24. The hang tag of claim 11, wherein the hang tan has a thickness of about 1 mil to about 30 mils.

25. The hang tan of claim 24, wherein the hang tan has a thickness of about 5 mils to about 10 mils.

26. The hang tag of claim 11, wherein said slot has minimum dimensions of at least about 0.312 inches by about 1.25 inches.

27. The hang tag of claim 26, wherein said slot has minimum dimensions of at least about 0.375 inches by about 1.375 inches.

28. A hang tag capable of automatically and permanently being attached to an elongated object by a machine having at least one jaw suitable for applying a securement strap to the object, the hang tag comprising:

a first surface, a second surface, and a slot defined therebetween; wherein said slot has minimum dimensions of at least about 0.25 inches by about 1 inch thereby permitting the jaw to travel through the slot so that the securement strap is threaded through the slot automatically by the jaw of the machine; wherein said slot is at least 0.1 inches from any edge of said hang tag; wherein said slot has at least one arcuate edge; wherein at least a portion is formed of a material selected from the group consisting of a polyethylene, polystyrene, polyolefins, polyphenylene, polycarbonate, polyvinylchloride, nylons, acrylics, aluminum, and combinations thereof; and wherein at least a portion is formed of a cross-laminated material.

29. The hang tag of claim 28, wherein the hang tag can hold a 5 lb weight without slipping from an original position on the elongated object by more than 0.5 inches.

30. A hang tag capable of automatically and permanently being attached to an elongated object by a machine having at least one jaw suitable for applying a securement strap to the object, the hang tag comprising:

a first surface, a second surface, and a slot defined therebetween, wherein said slot has minimum dimensions of at least about 0.312 inches by about 1.25 inches thereby permitting the jaw to travel through the slot so that the securement strap is threaded through the slot automatically by the jaw of the machine; wherein said slot is at least 0.15 inches from any edge of said hang tag; wherein said slot has at least one arcuate edge; wherein at least a portion is formed of a material selected from the group consisting of a polyethylene, polystyrene, polyolefins, polyphenylene, polycarbonate, polyvinylchloride, nylons, acrylics, aluminum, and combinations thereof; and wherein at least a portion is formed of a cross-laminated material.

31. The hang tag of claim 30, wherein the hang tag can hold a 5 lb weight without slipping from an original position on the elongated object by more than 0.5 inches.

* * * * *